US006227013B1

(12) United States Patent
Wyatt-Smith

(10) Patent No.: US 6,227,013 B1
(45) Date of Patent: May 8, 2001

(54) WASH PLATE FOR A CLOTHES WASHER

(75) Inventor: Vicki Lyn Wyatt-Smith, Watervliet, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/282,240

(22) Filed: Mar. 31, 1999

(51) Int. Cl.[7] ..... D06F 17/10
(52) U.S. Cl. ..... 68/134; 68/23 R
(58) Field of Search ..... 68/23 R, 23.7, 68/133, 134, 53

(56) References Cited

U.S. PATENT DOCUMENTS

| | | | | |
|---|---|---|---|---|
| 1,688,031 | * | 10/1928 | Altorfer | 68/133 |
| 1,712,755 | * | 5/1929 | Dieten | 68/134 |
| 1,747,750 | * | 2/1930 | Beatty | 68/133 |
| 3,736,775 | | 6/1973 | Smith | 68/23 |
| 4,494,390 | | 1/1985 | Hayashi et al. | 68/23.7 |
| 4,987,627 | | 1/1991 | Cur et al. | 68/17 |
| 5,253,380 | | 10/1993 | Lim et al. | 8/158 |
| 5,353,612 | | 10/1994 | Noguchi et al. | 68/12.02 |
| 5,460,018 | | 10/1995 | Werner et al. | 68/23.6 |
| 5,504,955 | | 4/1996 | Mueller et al. | 81/158 |
| 5,595,072 | | 1/1997 | Bai et al. | 68/133 |
| 5,619,870 | | 4/1997 | Kim et al. | 68/3.55 |
| 5,791,167 | | 8/1998 | Wyatt et al. | 68/134 |
| 5,839,300 | * | 11/1998 | Yoon et al. | 68/134 |
| 6,070,439 | * | 6/2000 | Jung | 68/134 |

FOREIGN PATENT DOCUMENTS

| | | | | |
|---|---|---|---|---|
| 10050 | * | 11/1933 | (AU) | 68/134 |
| 1129655 | * | 9/1956 | (FR) | 68/134 |
| 62-201189 | * | 9/1987 | (JP) | 68/134 |
| 1-146575 | * | 6/1989 | (JP) | 68/134 |
| 1-320089 | * | 12/1989 | (JP) | 68/134 |

* cited by examiner

*Primary Examiner*—Frankie L. Stinson
(74) *Attorney, Agent, or Firm*—Thomas J. Roth; Robert O. Rice; Joel M. Van Winkle

(57) ABSTRACT

A wash plate for a clothes washer having upwardly extending fins and triangular shaped protrusions spaced between the fins. A hub extends upwardly from the center of the wash plate to keep clothes separated. The wash plate has holes provided on the surface to allow mixing of wash liquid and draining of water from clothing. The fins assist in pushing clothing in a circular motion around the hub and the triangular protrusions open the clothes. Opening the clothes keeps them from tangling and allows wash liquid and water to be more evenly dispersed on the clothing.

18 Claims, 3 Drawing Sheets

WASH PLATE FOR A CLOTHES WASHER

BACKGROUND OF THE INVENTION

1. Field of the Invention

The present invention relates to a clothes washing machine, and more specifically to a wash plate therefor having fins and triangular protrusions positioned along its surface to distribute wash liquid and clothes evenly and enhance washability.

2. Description of the Related Art

The general construction of clothes washers is well known in the art. A common type of washing machine is the vertical axis washer having an agitator and incorporating a submersion process. An imperforate tub is mounted in a perforated wash basket for receiving clothing and the tub is filled with a wash liquid of detergent and water. An oscillating agitator imparts mechanical energy to the submerged clothing.

There have been advances in agitator washers improving the overall energy efficiency such as the vertical axis washer described in U.S. Pat. No. 4,987,627 (Cur et al.) that uses less energy and water through an improved wash process.

Additionally, since a relatively large amount of water is used to submerge the clothes in an agitator washer, alternate clothes washers have been developed that do not require a conventional agitator. One type of agitatorless washer that does not require complete submersion of clothes is described in U.S. Pat. No. 5,504,955 (Mueller). The washer in this patent has a wash basket disposed within a tub and rotatable about a vertical axis. A bottom plate is disposed within the lower portion of the wash basket and is mounted for a wobbling motion. This wobbly motion within the tub agitates and distributes the clothes during washing.

Furthermore, clothes washers range from those not having a wash plate to those having a wash plate that enhances washability. For example, the washer described in U.S. Pat. No. 2,802,356 (Kirby) does not have a wash plate or agitator. Instead, the wash basket is mounted for providing a wobbly motion within the tub. In U.S. Pat. No. 5,253,380 (Lim et al.), the pulsator, or wash plate, is designed with a plurality of radial ribs to cause a vortex flow within the rotatable tub. The ribs have axial holes to pass air bubbles to the tub. In U.S. Pat. No. 5,791,167 (Wyatt et al.), a wash plate having a clothes deflector is described. This wash plate is designed to seal the wash plate against the wash basket.

For clothes washers having a wash plate, it is desirable to have one that increases washability and reduces twisting and damaging of the clothes.

SUMMARY OF THE INVENTION

The present invention is directed to a wash plate for an automatic clothes washer. Typically the washer has an imperforate wash tub, a rotatable wash basket provided within the tub and a wobble/nutate wash plate within the wash basket. The clothes washer has a drive system for rotating the wash basket and wobbling/nutating the wash plate.

It is an object of the invention to provide a wash plate with a center area and a surrounding skirt area having a substantially circular outer perimeter. There is a hub extending upwardly from the center of the wash plate and fins and protrusions encircling the hub and extending upwardly from the wash plate. The hub is at a height greater than that of the fins and the fins are at a height greater than that of the protrusions.

It is an object of the invention to provide a wash plate having at least three fins extending upwardly from the skirt so as to divide the skirt area into at least three substantially equal sections. A plurality of protrusions extend upwardly from the skirt area and are provided within each of the sections.

It is a further object of the invention to provide at least three fins on the wash plate. Each fin has a left and a right planar side and a top and a bottom edge. Each fin is connected to the skirt area along its bottom edge and extends radially away from the hub toward the skirt perimeter. The top edge of each fin is positioned further from the skirt near the hub than near the skirt perimeter. The fins are integrally molded to the wash plate.

Another object of the invention is to provide protrusions that are polygonal in shape and are integrally molded to the wash plate. The protrusions have three planar faces, each face being substantially triangularly shaped. Each face has three angles and one angle of each face meets at a common point making each protrusion substantially a three-sided pyramid.

It is an object of the invention to provide three protrusions within each of the sections. Therefore, there are fins defining equal sections, and three protrusions are positioned within each of the three sections.

It is a further object of the invention to provide protrusions on the skirt at different radial lengths from the hub. Each section has a middle protrusion and two outer protrusions. The middle protrusion is positioned at a first length from the hub and the outer two protrusions are positioned at a second length from the hub.

An object of the invention is to provide a wash plate having a substantially circular center area with a hub extending upwardly therefrom. A skirt area surrounds the center area and has an outer perimeter. Three fins are spaced equidistantly on and extend upwardly from the skirt area. The fins extend substantially radially away from the center area and define three equal sections. Two outside and one inside multi-faced protrusions extend upwardly from the skirt within each section.

Further, it is an object of the invention to provide a wash plate having a skirt that defines an upwardly sloping surface from the outer perimeter toward the hub.

DESCRIPTION OF THE PREFERRED EMBODIMENT

The present invention may be used with an impeller action or wobble action washer. The wash plate works particularly well in a washer that imparts a wobbling or nutating action to the wash plate similar to that disclosed in U.S. Pat. No. 5,460,018 (Werner et is al.) issued Oct. 24, 1995, the disclosure of which is hereby incorporated by reference.

Figure 1:
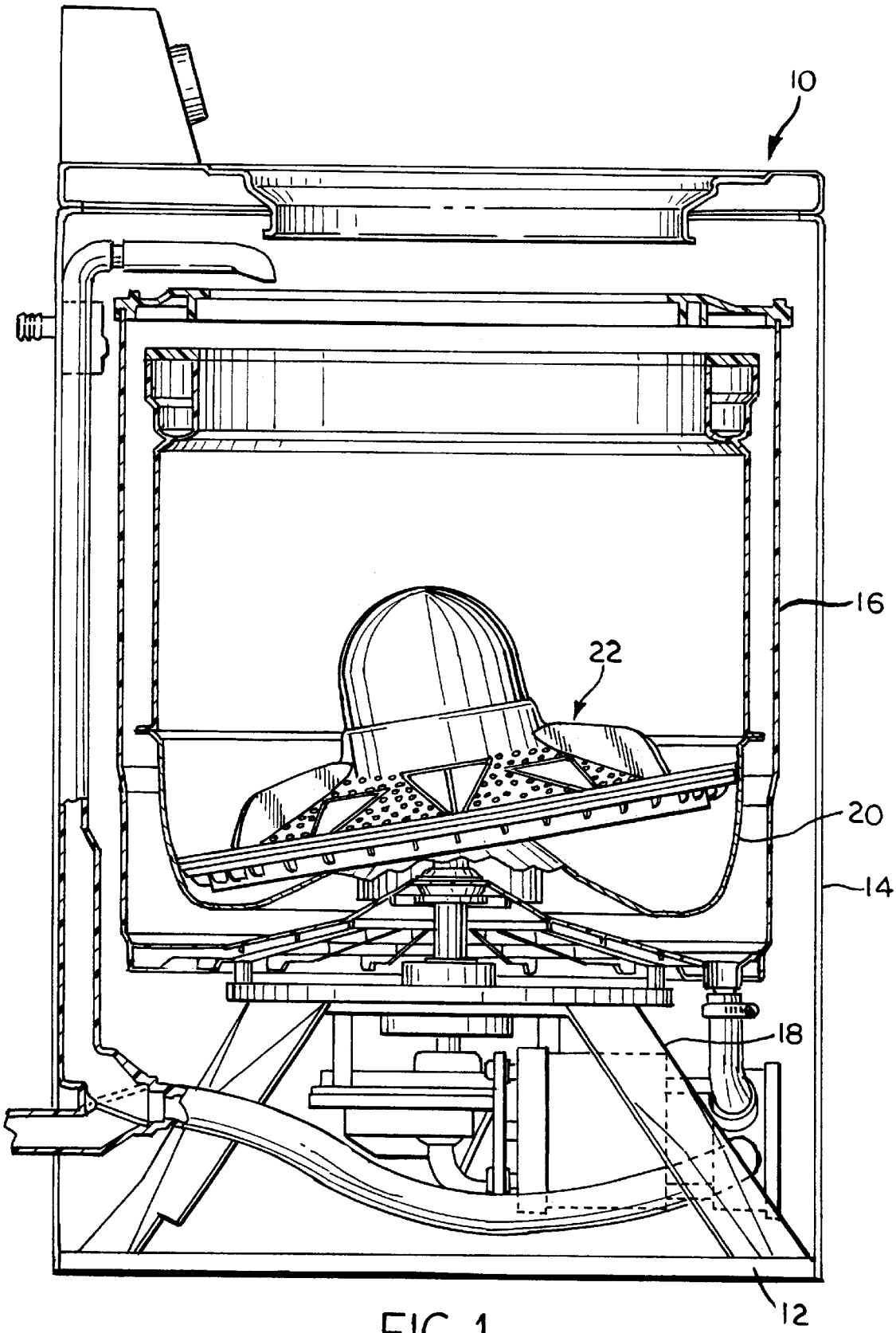
FIG. 1 is a side sectional view of an automatic washer incorporating a wash plate with fins and protrusions according to the present invention.

FIG. 1 illustrates a clothes washing machine 10 providing the environment of the invention. The washer comprises a frame 12 supporting a cabinet 14. An imperforate wash tub 16 is supported within the cabinet 14 by multiple struts 18 extending from the frame 12. A wash basket 20 is positioned within the wash tub 16 and a wash plate 22 is positioned within the wash basket near its bottom. The detailed internal structure of a washer that might contain the wash plate herein is disclosed in U.S. Pat. No. 5,460,018.

Figure 2:
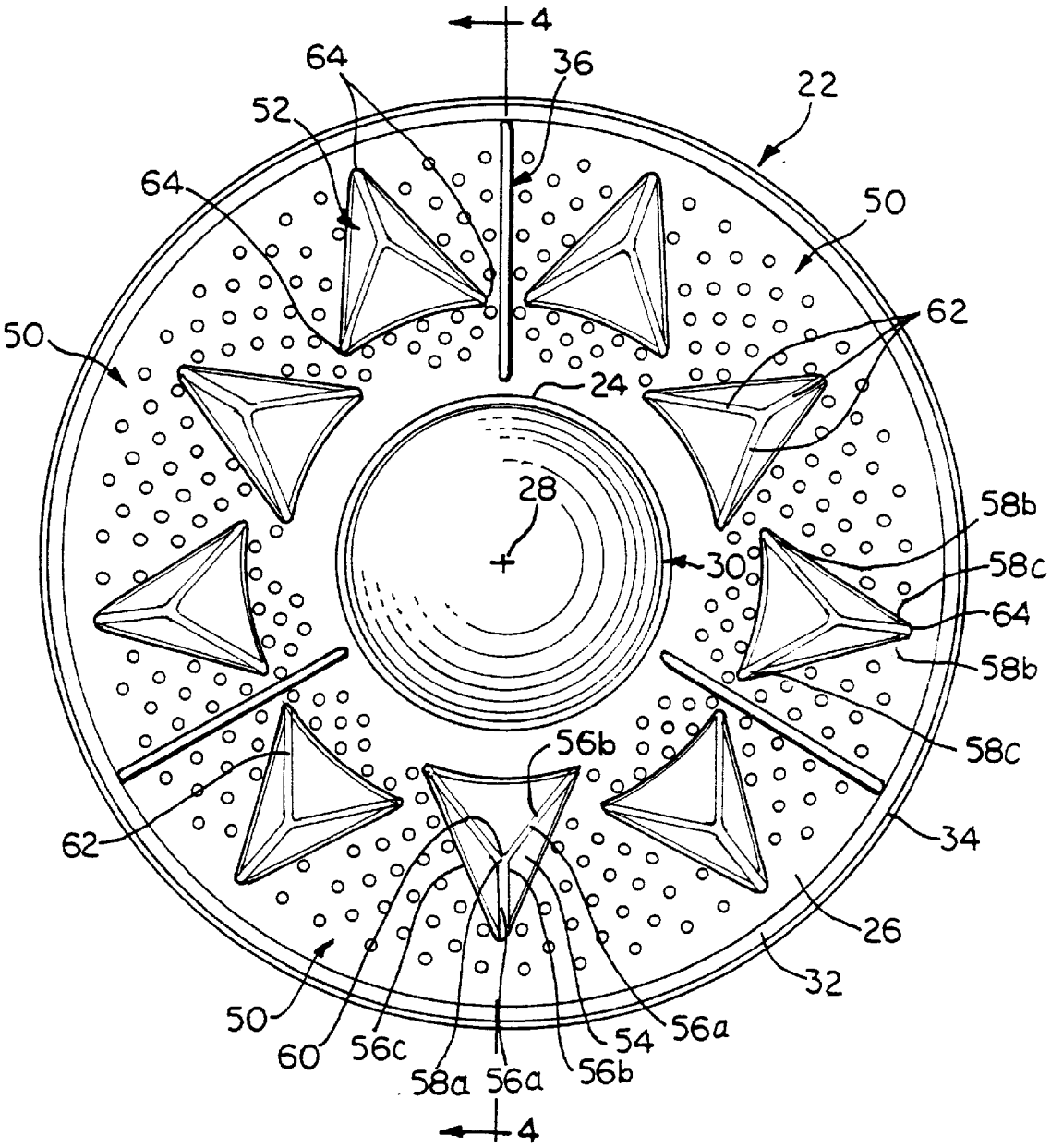
FIG. 2 is a planar view of the wash plate.
Figure 3:
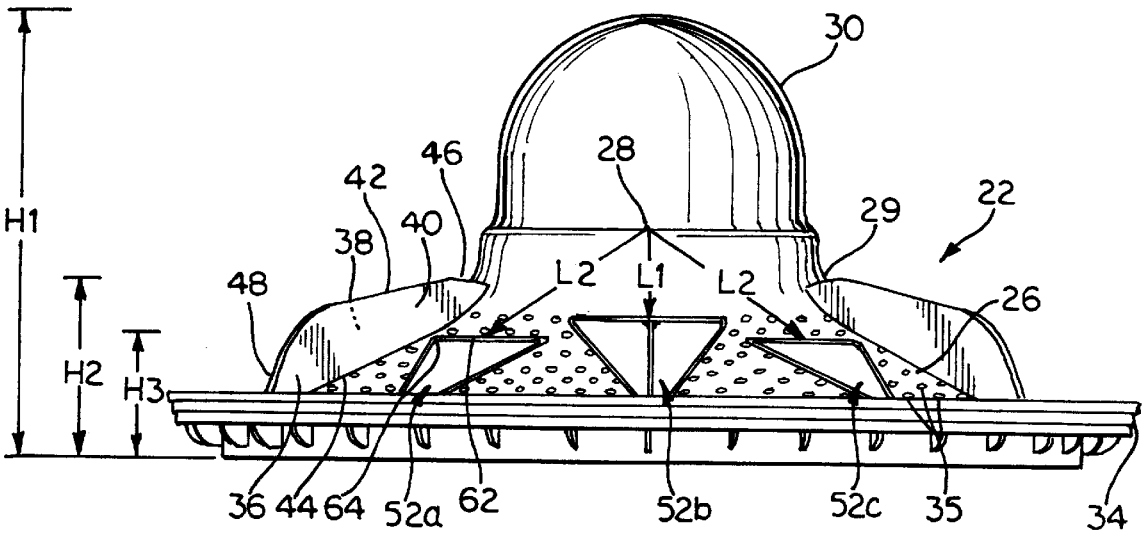
FIG. 3 is a side view of the wash plate.
Figure 4:
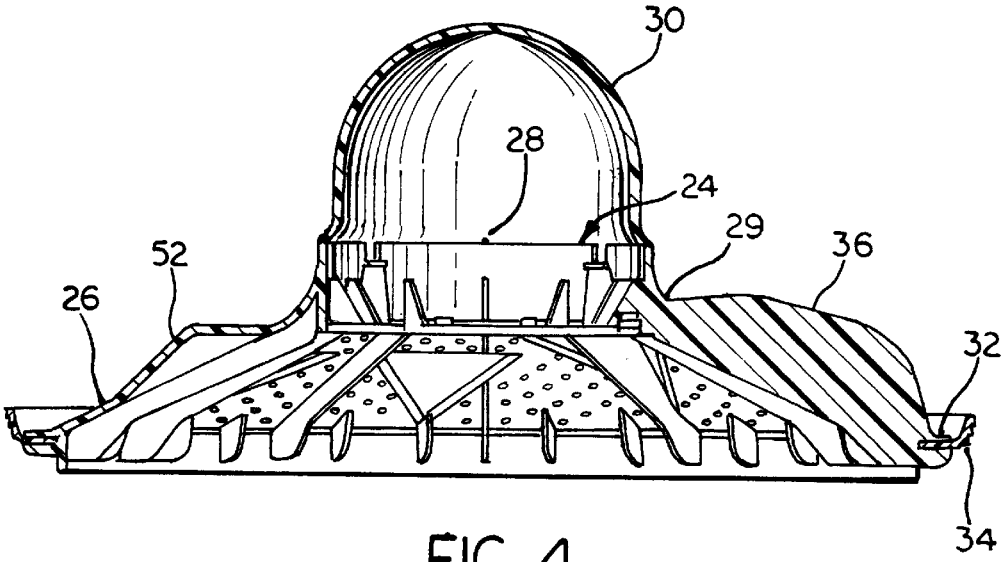
FIG. 4 is a cross-sectional view of the wash plate taken along line 4—4 of FIG. 2.

FIGS. 2–4 illustrate the wash plate 22 in greater detail. The wash plate is generally circular and comprises a substantially circular center area 24 having a midpoint 28 and a surrounding skirt area 26. There is a raised hub 30 having a generally circular perimeter 29 positioned at the center area of the wash plate. The hub has a generally cylindrical body with a dome shaped top to facilitate separation of clothes without damaging them, as shown in FIG. 3. However, there are many different possible ornamental appearances for the hub, for example, the hub 30 could have ribs extending across the top and down the cylindrical body or the hub could consist of multiple fins extending from the top downwards to form the body. The hub is at a height Hi to facilitate separation of clothes; not too low so that clothes just slide unaffected over it, but not too high that it impedes the movement of clothes. To increase the clothes capacity within the washer, a preferred height range for the hub could be anywhere from 4 to 10 inches from the skirt area nearest the hub, or the hub's circular perimeter 29. The hub 30 may be integrally molded with the wash plate 22 or it may be a separate member that is attached to the wash plate 22.

The skirt area 26 of the wash plate extends from the hub's perimeter 29 in a generally downward slope to the perimeter of the skirt or periphery lip 32. It is found that the sloped skirt helps keep clothes from tangling during the wash process and the slope of the skirt 26 might be between 150° to 35°. The slope of the described embodiment is approximately 25°, as shown in FIG. 4. The periphery lip 32 is substantially circular and might have a clothes deflector 34 to seal the wash plate 22 with respect to the wash basket 20 as shown in U.S. Pat. No. 5,791,167. The skirt area 26 may have multiple perforations 35 as shown in FIG. 3 to allow mixing of a detergent and draining of wash liquid from the clothes and the area above the wash plate 22.

Fins 36 are positioned on the wash plate 22 and extend upwardly therefrom. As can be seen in FIGS. 2–4, the fins 36 have a left planar side 38 and a right planar side 40. Each fin has a top edge 42 and a bottom edge 44. The fin is positioned on the skirt 26 along its bottom edge 44 and may be integrally molded with the wash plate 22. Each fin has a front end 46 and a back end 48 whereby the front end 46 is positioned near the hub 30 and the fin 36 extends radially therefrom with the back end 48 positioned toward the periphery lip 32. The front end 46 of the fin 36 shown in FIG. 2 is positioned at the circular perimeter 29 of the hub and the back end 48 is positioned a distance from the periphery lip 32 of the wash plate 22. The top edge 42 of the fin is generally smooth without any sharp angles to avoid damage to the clothes and the top edge 42 of the fin is at a greater distance from the skirt area toward the periphery lip than toward the hub.

At least two fins 36 extend radially from the hub 30 to facilitate the movement of clothing in a circular direction around the hub. As shown in FIG. 3, the fins 36 are at a height H2 less than the height Hi of the hub 30, but at a height H2 great enough to help push the clothes. There may be any number of fins 36, however too many fins result in the clothing moving across the top of the fins and negates their purpose. It is found that three fins 36 work well to control the motion of the clothes by pushing them in a circular direction while allowing them to contact the skirt area 26 of the wash plate 22 during rotation and/or wobbling.

The fins 36 divide the wash plate and thus the skirt into substantially equal sections 50. Thus, three fins divide the skirt area 26 into three substantially equal sections 50.

Polygonal protrusions 52 are positioned on the wash plate 22 and extend upwardly therefrom, as shown in FIG. 3. They are at a height H3 less than the height of the fins H2. The protrusions 52 may have any number of faces 54, but are preferably not round. Each face 54 is planar and has edges 56 and angles 58 defining the shape of the face. For example, the preferred embodiment shown in FIG. 2 has three faces 54 and each face has three edges 56*a*, 56*b*, 56*c* and three angles 58*a*, 58*b*, 58*c* forming a triangular shaped face. Each face has a bottom edge 56*c* integrally formed on the wash plate 22 and a right edge 56*a* and a left edge 56*b* that extend upwardly from the wash plate. Right edge 56*a* and left edge 56*b* meet at an angle 58*a* and angle 58*a* of all three faces 54 meet at a common point 60. Right edge 56*a* and bottom edge 56*c* of each face meet at right angle 58*b* and left edge 56*b* and bottom edge 56*c* of each face meet at left angle 58*c*.

It can be seen in FIGS. 2 and 3 that left edge 56*b* of a first face is positioned along right edge 56*a* of a second face and right edge 56*a* of a first face is positioned along left edge 56*b* of a third face and right edge 56*a* of a third face is positioned along left edge 56*b* of a second face to form three edge junctures 62. Left angle 58*c* of a first face abuts right angle 58*b* of a second face and right angle 58*b* of a first face abuts left angle 58*b* of a third face and right angle 58*b* of a third face abuts left angle 58*b* of a second face to form three points 64 that are positioned substantially on the wash plate 22. It is preferable that the three edge junctures 62 do not form sharp edges and the common point 60 does not form a sharp point. The junctures and common point may be somewhat rounded or multi-faceted to prevent clothing from being damaged. As shown in FIG. 2, the protrusion 52 has three smooth, rounded junctures 62 and points 64 and one smooth, rounded common point 60.

The protrusions 52 are positioned on the skirt within the sections and an equal number of protrusions may be provided within each section. The protrusions 52 act like "fingers" poking at the clothes to open them up. There should be enough protrusions to open the clothes and allow an even distribution of the wash liquid, but not too many protrusions so that the clothes slide across the top of the "fingers" resulting in twisting of the clothes. It is found that three protrusions 52*a*, 52*b*, 52*c* work well within each of the three sections 50 formed by the three fins 36.

The three protrusions 52 consist of one inner protrusion 52*b* and two outer protrusions 52*a*, 52*c*. Each of the protrusions is positioned a radial length L from the midpoint 28 of the center area. It is found that positioning the protrusions 52 at more than one length from the midpoint increases their effectiveness. The preferred wash plate embodiment provides a first length L1 for the inner protrusion 54*b* and a second length L2 for the outer protrusions 52*a*, 52*c*.

While the present invention has been described with reference to the above described embodiment, those of skill in the art will recognize that changes may be made thereto without departing from the scope of the invention as set forth in the appended claims.

I claim:

1. A wash plate for an automatic washer for washing clothes, the wash plate comprising:

a center area, a skirt area surrounding said center area, said skirt area having a substantially circular outer perimeter, a hub extending upwardly from the center area, at least three fins provided on and extending upwardly from the skirt area and dividing the skirt area into at least three substantially equal sections, a plurality of protrusions positioned within each of the at least three sections and provided on and extending upwardly from the skirt area, the fins extend at a fin height, the hub extends at a hub height and the protrusions extend at a protrusion height, and the hub height is greater than the fin height and the fin height is greater than the protrusion height.

2. The wash plate as defined in claim 1, wherein:

said at least three fins consists of no more than three fins.

3. The wash plate as defined in claim 1, wherein:

each of said fins has a left and a right planar side and a top and a bottom edge, each fin is connected to the skirt area along its bottom edge and extends radially away from said hub toward said skirt perimeter, and the top edge of each fin is positioned further from said skirt near the skirt perimeter than near the hub.

4. The wash plate of claim 3, wherein:

the fins are integrally molded to the wash plate.

5. The wash plate as defined in claim 1, wherein:

the plurality of protrusions are polygonal in shape.

6. The wash plate as defined in claim 5, wherein:

the protrusions have three planar faces, each face being substantially triangularly shaped.

7. The wash plate as defined in claim 6, wherein:

each face has three angles, one angle of each face meeting at a point common to the three faces whereby the protrusions are substantially pyramidal in shape.

8. The wash plate as defined in claim 7, wherein:

three protrusions are positioned within each of the at least three sections.

9. The wash plate as defined in claim 8, wherein:

each section has a middle protrusion and two outer protrusions, the middle protrusion being positioned at a first radial length from the hub and the outer protrusions being positioned at a second radial length from the hub.

10. The wash plate as defined in claim 7, wherein:

there are three fins defining three equal sections, and three protrusions are positioned within each of the three sections.

11. The wash plate as defined in claim 7, wherein:

the protrusions are integrally molded to the wash plate.

12. The wash plate as defined in claim 7, wherein:

each protrusion is positioned on the skirt a radial length from the hub and at least two protrusions have different lengths.

13. A wash plate for an automatic washer for washing clothes, the wash plate comprising:

a substantially circular center area, a hub extending upwardly from the center area, a skirt area surrounding the center area and having an outer perimeter, three equidistantly spaced fins provided on and extending upwardly from the skirt area, said fins extending substantially radially away from the center area and defining three equal sections, and two outside and one inside multi-faced protrusions extending upwardly from the skirt area within each section.

14. The wash plate as defined in claim 13, wherein:

each protrusion has three faces and each face is substantially triangularly shaped.

15. The wash plate as defined in claim 14, wherein:

the outside protrusions are positioned on the wash plate a first radial length from the hub and the inside protrusion is positioned a second radial length from the hub.

16. The wash plate as defined in claim 13, wherein:

said skirt defines an upwardly sloping surface from the skirt outer perimeter toward the hub.

17. The wash plate as defined in claim 16, wherein:

each fin has a top edge positioned further from said skirt near the skirt outer perimeter than near the hub.

18. The wash plate as defined in claim 17, wherein:

the fins extend at a fin height, the hub extends at a hub height and the protrusions extend at a protrusion height, and the hub height is greater than the fin height and the fin height is greater than the protrusion height.

* * * * *